US008259043B2

(12) United States Patent
Schmidt et al.

(10) Patent No.: US 8,259,043 B2
(45) Date of Patent: Sep. 4, 2012

(54) HYBRID DRIVER FOR LIGHT-EMITTING DIODE DISPLAYS

(75) Inventors: John F. L. Schmidt, Phoenix, AZ (US); Kalluri R. Sarma, Mesa, AZ (US); Jerry A. Roush, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 1030 days.

(21) Appl. No.: 11/759,777

(22) Filed: Jun. 7, 2007

(65) Prior Publication Data

US 2008/0303804 A1 Dec. 11, 2008

(51) Int. Cl.
*G09G 3/32* (2006.01)
*G09G 3/30* (2006.01)

(52) U.S. Cl. ..... 345/82; 345/76

(58) Field of Classification Search ..... 345/76, 345/77, 82, 83, 204; 315/169.1, 169.3
See application file for complete search history.

(56) References Cited

U.S. PATENT DOCUMENTS

| | | | | |
|---|---|---|---|---|
| 4,167,406 | A | 9/1979 | Hauschild et al. | |
| 7,012,378 | B1 | 3/2006 | Wells et al. | |
| 7,167,406 | B2 | 1/2007 | Komiya | |
| 2005/0007334 | A1 * | 1/2005 | Park | 345/102 |
| 2005/0104820 | A1 | 5/2005 | Komiya | |
| 2005/0128193 | A1 * | 6/2005 | Lueder | 345/207 |
| 2005/0146281 | A1 * | 7/2005 | Ng et al. | 315/169.3 |
| 2007/0132674 | A1 * | 6/2007 | Tsuge | 345/77 |

FOREIGN PATENT DOCUMENTS

| | | | |
|---|---|---|---|
| CN | 1617204 | A | 5/2005 |
| CN | 1705002 | A | 12/2005 |
| EP | 1605432 | A2 | 12/2005 |
| EP | 1752955 | A1 | 2/2007 |

OTHER PUBLICATIONS

EP Search Report dated Nov. 30, 2009, EP 08157670.4-2205 / 2001009.

CN Office Action for Appln. No. 2008 10131476.3, dated Jun. 16, 2011.

* cited by examiner

*Primary Examiner* — Kevin M Nguyen
(74) *Attorney, Agent, or Firm* — Ingrassia Fisher & Lorenz, P.C.

(57) ABSTRACT

Apparatus, systems, and methods are provided for controlling the luminance of a display. One apparatus includes a pre-charge circuit configured to supply a pre-charge voltage to a column of LED pixels, a programming circuit configured to supply current to the column, and a switch configured to selectively couple the pre-charge circuit or the programming circuit to the column. A system includes an array of LED pixels arranged in a plurality of columns. A plurality of pre-charge circuits, each configured to selectively supply a pre-charge voltage to at least one column of pixels, and a plurality of current sources, each configured to selectively supply current to at least one column of pixels are also included. One method includes determining a pre-charge voltage for each of a plurality of columns based on a target luminance level selected from the plurality of luminance levels and supplying the determined pre-charge voltages to the columns.

19 Claims, 7 Drawing Sheets

HYBRID DRIVER FOR LIGHT-EMITTING DIODE DISPLAYS

FIELD OF THE INVENTION

The present invention generally relates to displays, and more particularly relates to a hybrid driver for light-emitting diode (LED) displays.

BACKGROUND OF THE INVENTION

Active matrix light emitting diode displays offer many potential advantages when compared to active matrix liquid crystal displays. Some advantages include, but are not limited to, superior image quality, thin profile, low power consumption, and lower cost.

Currently, two different methods are used in addressing active matrix liquid crystal displays; namely, voltage programming and current programming. A voltage programming method benefits from a large installed base of display drivers that operate in a voltage programming mode. However, voltage programmed pixel circuits suffer from the lack of ability to compensate for the variations in the pixel TFT drive currents across the surface of the display, which leads to luminance non-uniformities in the display. A current-programming method may compensate for the variations in the drive TFT performance across the display surface, which results in better display luminance and color uniformity than voltage-programmed pixels. For these reasons, current-programmed pixels are preferred over voltage-programmed pixels.

Notwithstanding the above-referenced preference, one drawback to current-programmed LED displays is that they exhibit longer pixel programming times than voltage-programmed pixels, particularly for lower gray levels. Longer pixel programming times are caused because current-programmed displays typically use small programming currents (e.g., 7.8 nA to 2 μA) for a typical 8-bit display driver with an 80 color groups per inch (CGPI) resolution, or even smaller currents for smaller pixel sizes in higher resolution displays. One reason for the prolonged programming time is that the data bus capacitances need to be charged before the pixel can be properly programmed, and it takes a significant amount of time to charge the data bus capacitances with these small amounts of programming current, as the data bus capacitance is significantly larger than the pixel capacitance. To alleviate this problem of slow pixel data programming times in current mode column drivers, voltage pre-charging methods have been developed as described in U.S. Pat. Nos. 7,012,378 and 7,167,406. U.S. Pat. No. 7,012,378 addresses the problem by sequentially (as the rows are scanned) applying a fixed DC pre-charge voltage to the data buses in the display during a short pre-charge interval, and then applying current programming to the pixels. The DC voltage pre-charge improves current-programmed pixel operation at low luminance (low programming currents); however, this fixed DC pre-charge voltage is useful for a very restricted range of display brightness levels (gray levels), as very low brightness levels (gray levels) require a different DC pre-charge voltage than very high brightness levels. U.S. Pat. No. 7,167,406, on the other hand, expands the pre-charge voltage's utility by providing a pre-charge voltage proportional to the desired pixel programming current; however, there are still significant shortcomings to the method described in U.S. Pat. No. 7,167,406. One shortcoming is that the use of a proportional DC pre-charge voltage does not result in sufficient display color and luminance uniformity due to the drive requirements for a red, green, and blue (R, G, B) LED pixel being different, and the pixel current feed-through effects. The pixel feed through current is a consequence of the pixel TFT switching at the end of the programming time, which may result in increasing or decreasing the current through the LED from the programmed value by $\Delta I_P$. This phenomenon produces a pixel luminance which is lower than the desired pixel luminance, and the value of $\Delta I_P$ depends upon the pixel gray level and the parasitic capacitance of the drive TFT.

The present invention substantially improves upon the prior art, and provides operational flexibility not provided by the prior art for achieving uniform color and gray level luminance in active matrix light emitting diode displays. The present invention integrates voltage pre-charge circuitry within the current-programmed column driver, and provides novel and practical means to optimize current-programmed pixel operation to achieve superior color and gray level luminance uniformity in the display. The present invention also provides programmable, non-proportional lookup tables to establish and define unique and optimum voltage pre-charge levels, and programming currents for each desired pixel color and luminance level (pixel gray level) by including compensation for the differences in R, G, B LED pixel drive requirements and current feed-through effects at the end of the pixel programming time.

Accordingly, it is desirable to provide drivers, displays, and methods for controlling the luminance of the LEDs in a display by decreasing the amount of time needed to charge the data bus capacitances. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

Various exemplary embodiments provide a driver for controlling the luminance of a display comprising a column of light-emitting diode (LED) pixels. The driver comprises a pre-charge circuit configured to supply a pre-charge voltage to the column of LEDs and a programming circuit configured to apply current to the column of LEDs. A switch configured to selectively couple the pre-charge circuit or the programming circuit to the column of LEDs is also included.

Exemplary embodiments of the invention also provide a display comprising an array of LED pixels arranged in a plurality of columns. The display also comprises a plurality of pre-charge circuits, each configured to selectively supply a pre-charge voltage based on pixel color gray level and feed-through current to at least one column of LED pixels, and a plurality of current sources, each configured to selectively supply current to at least one column of LED pixels.

Methods for controlling the luminance of a display comprising a plurality of columns of LED pixels characterized by a plurality of luminance levels are also provided. In one exemplary embodiment, the method comprises the steps of determining a pre-charge voltage for each of the columns of LED pixels based on a target luminance level selected from the plurality of luminance levels and supplying the determined pre-charge voltage to each of the columns of LED pixels.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
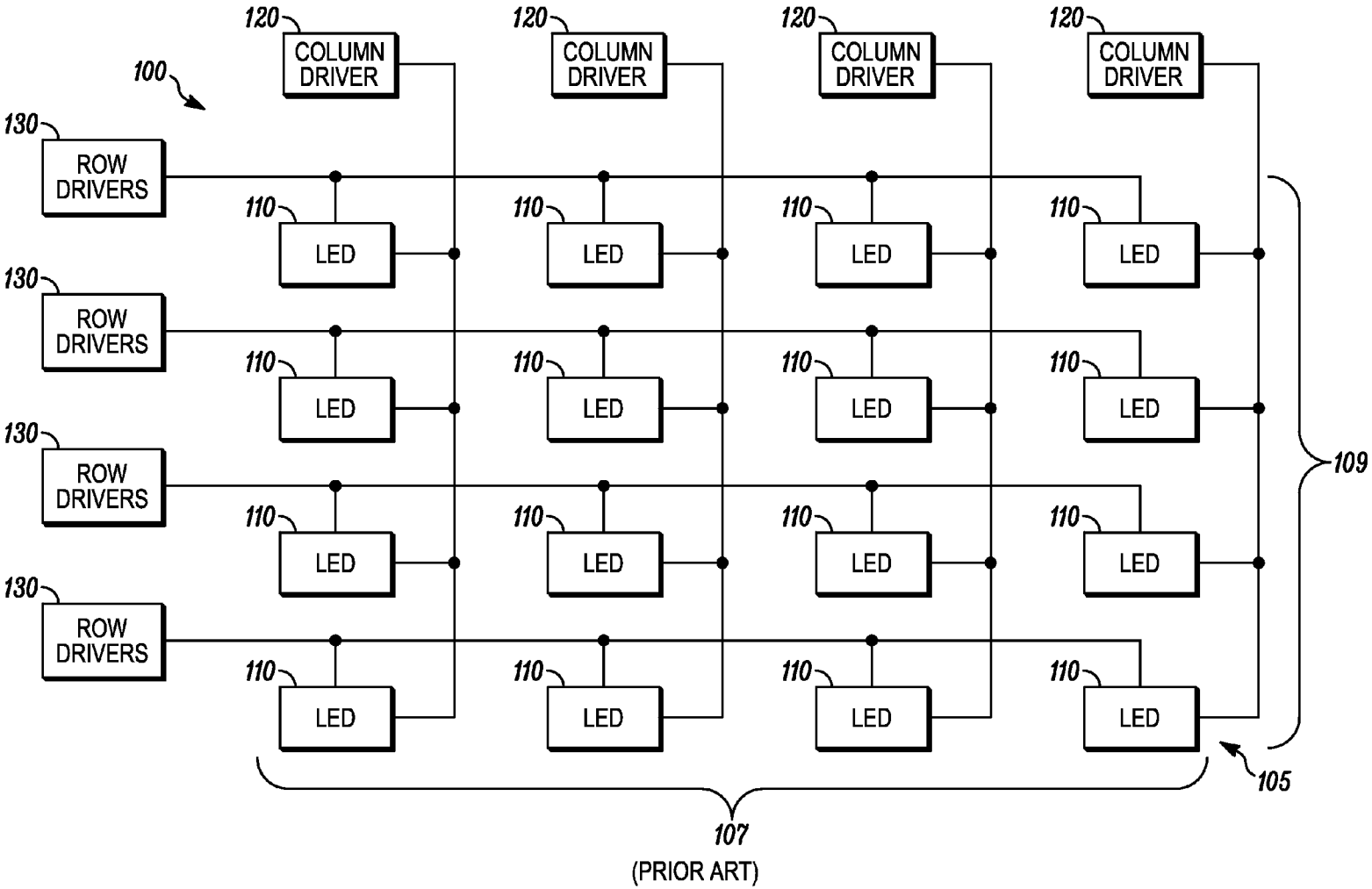
(PRIOR ART) FIG. 1
FIG. 1 is a schematic diagram of a prior art display.

FIG. 1 is a schematic diagram of a prior art display 100 including an array 105 of active matrix light-emitting diode (AMLED) pixels 110 arranged in a plurality of columns 107 and rows 109. Each of the columns 107 is coupled to a different column driver 120 and each of the rows 109 is coupled to a different pair of row drivers 130.

Figure 2:
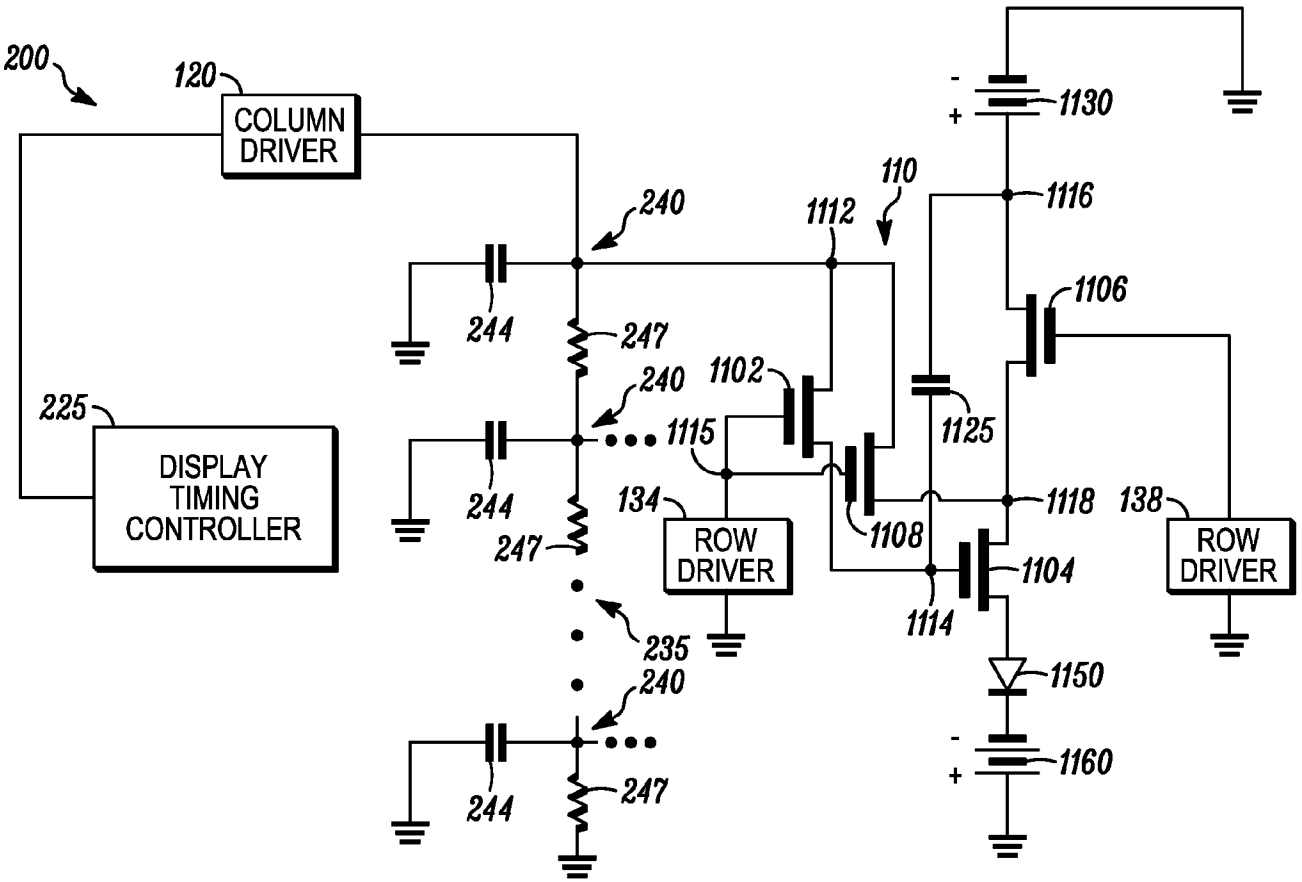
(PRIOR ART) FIG. 2
FIG. 2 is a schematic diagram of a portion of the display of FIG. 1.

As shown in FIG. 2, which is a more detailed schematic diagram of a portion 200 of display 100, each of the column drivers 120 are coupled to a display timing controller 225 that is configured to transmit video data to column drivers 120. Furthermore, each of the column drivers 120 and each of the pairs of row drivers 130 operate in conjunction with one another to provide current to, and thus illuminate, each of the AMLED pixels 110. The rows 109 are illuminated one row at a time during a cycle, and a period of time when each of the AMLED pixels is OFF (i.e., a blanking period) is inserted between successive cycles.

As FIG. 2 also depicts, column driver 120 is coupled to each of the AMLED pixels 110 in its respective column 107 via a data bus 235. Data bus 235 comprises a plurality of resistor-capacitor (RC) circuits 240, each comprising a capacitive element (e.g., one or more capacitors) 244 coupled in parallel with a resistive element (e.g., one or more resistors) 247. Each RC circuit 240 is further coupled (via a node 1112) to a switch (e.g., a semiconductor switch) 1102 of AMLED pixel 110.

Switch 1102 is coupled to (via a node 1115), and switched ON/OFF by, a row driver 134 (coupled to ground) of the pair of row drivers 130 (see FIG. 1). Switch 1102 is also coupled to a node 1114, and node 1114 is coupled to a capacitor 1125 and a switch 1104. Switch 1104 is switched ON/OFF by current supplied from capacitor 1125 and column driver 120 (via row driver 134 and switch 1102). Capacitor 1125 is also coupled to a node 1116, and node 1116 is coupled between the positive terminal of a voltage source 1130 (the negative terminal being coupled to ground) and a switch 1106.

Switch 1106 is coupled to, and switched ON/OFF by, a row driver 138 (coupled to ground) of the pair of row drivers 130 (see FIG. 1), and is also coupled to a node 1118. Node 1118 is coupled to switch 1104, switch 1106, and a switch 1108. Switch 1108 is coupled to (via node 1115), and switched ON/OFF by, row driver 134, and is also coupled to node 1112.

AMLED pixel 110 also includes an LED 1150. LED 1150 is coupled to switch 1104 and coupled to a negative terminal of a voltage source 1160, the positive terminal being coupled to ground.

Figure 3:
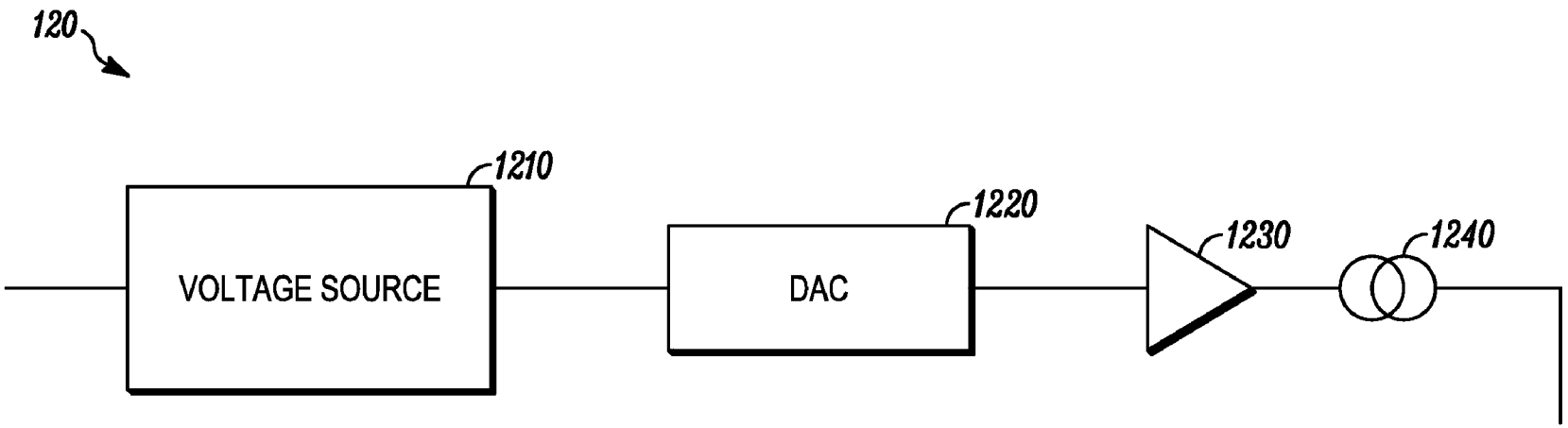
(PRIOR ART) FIG. 3
FIG. 3 is a schematic diagram of a prior art column driver of the display of FIG. 1.

FIG. 3 is a schematic diagram of one of the column drivers 120 (see FIG. 1). Column driver 120 includes a voltage source 1210 coupled to a digital-to-analog converter (DAC) 1220, which is configured to convert digital voltages to analog voltages. DAC 1220 is also coupled to a buffer 1230, which is coupled to a current converter 1240. Current converter 1240 is configured to generate current from the analog voltage signal produced by DAC 1220 (and amplified by buffer 1230).

During operation, voltage source 1210 receives video data from display timing controller 225 (see FIG. 2) and generates a digital representation of the desired analog voltage, hereafter referred to as a digital voltage. The generated digital voltage varies depending on the brightness and/or color of the AMLED pixel(s) 110 to be illuminated. DAC 1220 then converts the digital voltage to an analog voltage, and the analog voltage is supplied to buffer 1230 for amplification. The amplified analog voltage is converted to current by current converter 1230, and current converter 1230 supplies the current to data bus 235 (see FIG. 2) in conjunction with current supplied from the pair of row drivers 130.

Figure 4:
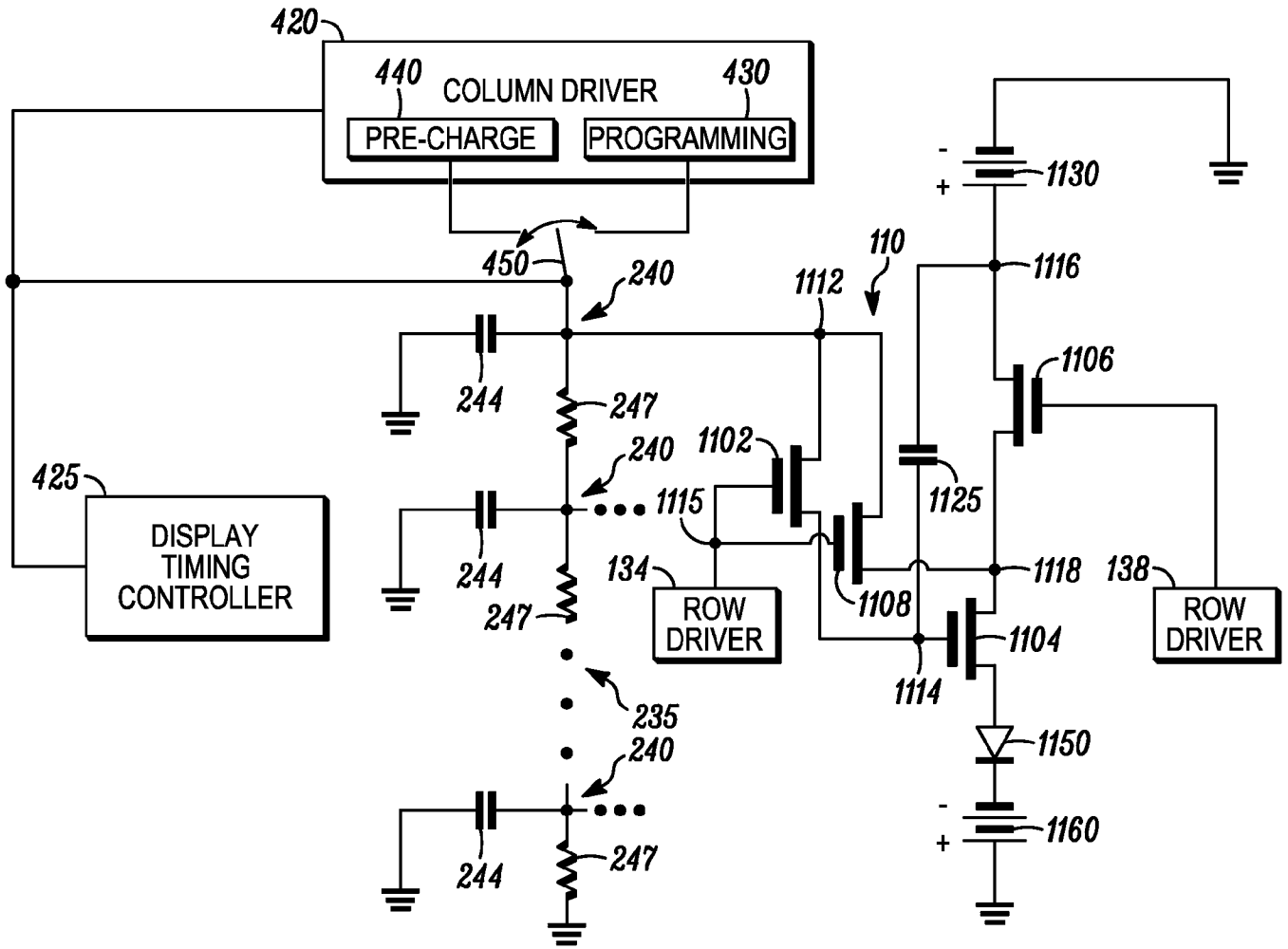
FIG. 4 is a schematic diagram of a portion of a display in accordance with one exemplary embodiment of the invention.

FIG. 4 is a schematic diagram of a portion an exemplary embodiment of a display 400, which comprises some components similar to display 100 discussed above. Display 400 comprises a display timing controller 425 coupled to a column driver 420 and a switch 450. Display timing controller 425 is configured to transmit video data to column driver 420 and switch 450 based on the information to be shown on display 400.

Column driver 420 comprises a programming circuit 430 and a pre-charge circuit 440, which are each selectively coupled to AMLED pixels 110 via switch 450. Programming circuit 430 is configured to provide current to AMLED pixels 110 (via switch 450) in conjunction with the pair of row drivers 130 for each respective row 109. Pre-charge circuit 440 is configured to provide a pre-charge voltage (via switch 450) to data bus 235 to pre-charge each capacitor 244 prior to programming circuit 430 and row drivers 134 and 138 providing current to AMLED pixels 110.

Figure 5:
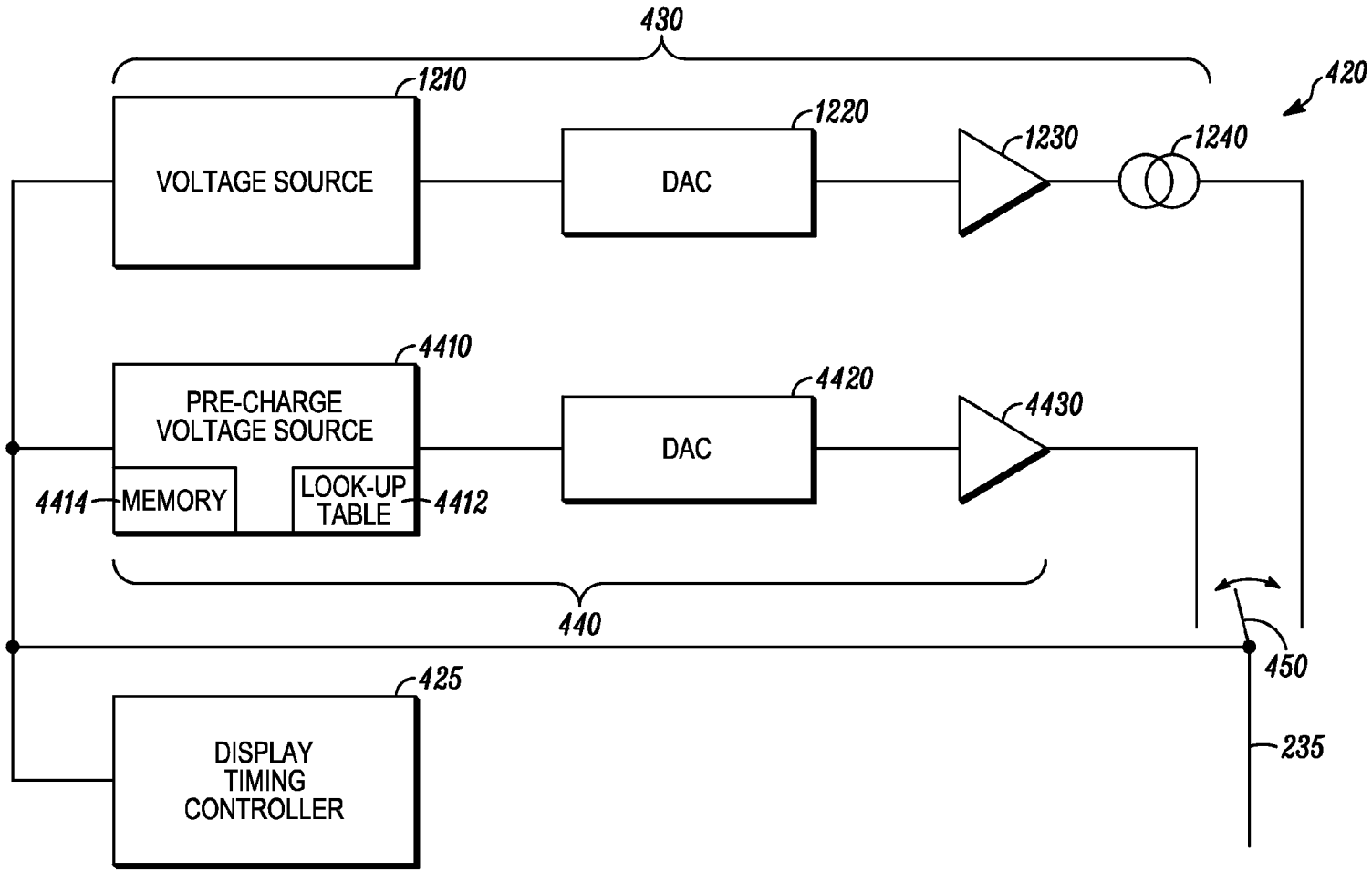
FIG. 5 is a schematic diagram of an exemplary embodiment of a column driver.

FIG. 5 is a schematic diagram of one exemplary embodiment of programming circuit 430 and pre-charge circuit 440 of column driver 420. Programming circuit 430 comprises voltage source 1210, DAC 1220, buffer 1230, and current converter 1240 configured similar to previously-discussed column driver 120 (see FIG. 3). Because the configuration and operation of this circuit has already been discussed, it will not be discussed again.

Pre-charge circuit 440 comprises a programmable pre-charge voltage source 4410 coupled to a DAC 4420 (e.g., a voltage digital-to-analog converter (VDAC)), which is configured to convert digital voltages to analog voltages. In one embodiment, pre-charge voltage source 4410 comprises a look-up table 4412 and a memory 4414. Look-up table 4412 is configured to store a plurality of voltages corresponding to a plurality of luminance levels for each of the AMLED pixels 110 in its respective column 107. In another embodiment, lookup table 4412 is implemented globally (i.e., "off-board") on a separate chip (not shown), and is in communication with each column driver 420 of the display. In yet another embodiment, look-up table 4412 is a global lookup table that downloads (e.g. at power up) into memory 4414 of each of the column drivers 420.

As noted, look-up table 4412 comprises a plurality of digital voltage values that correspond to a plurality of brightness levels for AMLED pixels 110. For example, AMLED pixels 110 are capable of being illuminated at 256 brightness levels, and look-up table 4412 stores individual digital voltages that correspond to each voltage level. That is, for brightness levels ranging from level 0 to level 255, look-up table 4412 stores 256 digital voltage values that correspond to the 256 brightness levels. In one embodiment, look-up table 4412 stores voltage values from about 0 volts to about 15 volts. Although the example specifically recites 256 levels and an associated range of voltages, the invention contemplates that look-up table 4412 may include any number of brightness levels and various ranges of voltages that vary depending on the desired brightness (luminance) of display 400 That is, the invention contemplates the use of an infinite number of voltages to produce an infinite number of colors and/or brightness levels.

In accordance with one exemplary embodiment, look-up table 4412 is a non-proportional look-up table. That is, look-up table 4412 comprises voltage values to compensate for non-ideal display operating characteristics (e.g., delta current feed through) related to the color and circuit design of AMLED pixel 110, in addition to the pre-charge voltage needed for gray level. Specifically, when AMLED pixel 110 is programmed to a desired current, and is then commanded to operate in hold mode, the current through AMLED pixel 110 changes from its programmed current value by an amount equal to the delta current feed through. Parasitic capacitances between the transistor gates and the transistor source and drain connections of AMLED pixel 110 cause bias voltage shifts when the transistors are enabled and disabled. These voltage shifts, in turn, produce changes in the programmed current values.

With respect to color produced by AMLED pixel 110, each color is produced by a diode (e.g., diode 1150) with unique electrical properties because the dielectric constant may be unique for any given emitter material. The forward voltages of diode 1150 may also be unique, and the conductive properties of each diode 1150 will vary. The degree to which any of these characteristics adversely affects programming of AMLED pixel 110 may be characterized, and a particular compensation voltage applied by lookup table 4412 based on these factors. Specifically, look-up table 4412 provides compensation for gray level, the circuit design of AMLED pixel 110, and the color of AMLED pixel 110 when the programming current and pre-charge voltage are determined and applied to display 400.

In another embodiment, the pre-charge voltage is one of a plurality of pre-determined voltages based on an associated gray level of the image to be displayed. That is, pre-charge voltage source 4410 is configured to modify the amount of pre-charge voltage it supplies to DAC 4420 based on the gray level of each respective image to be displayed on display 400.

During operation, display timing controller 425 commands switch 450 to couple pre-charge circuit 440 to data bus 235. Display timing controller 425 also provides video data to pre-charge circuit 440. In response to the video data, pre-charge circuit 440 utilizes look-up table 4412 to determine the amount of voltage needed to charge capacitive elements 244 for the particular image to be displayed on display 400. Once the proper pre-charge voltage is determined, pre-charge voltage source 4410 supplies the voltage to DAC 4420, which converts the digital voltage to an analog voltage. The analog voltage is amplified by buffer 4430 and applied to the capacitive elements 244 on data bus 235 via switch 450.

Once the capacitive elements are appropriately pre-charged, display timing controller 425 commands switch 450 to connect data bus 235 to programming circuit 430. Programming circuit 430 and row drivers 134 and 138 then provide current to each AMLED pixel 110 so that individual pixels in array 105, are illuminated with the appropriate color(s) and/or brightness(es).

Figure 6:
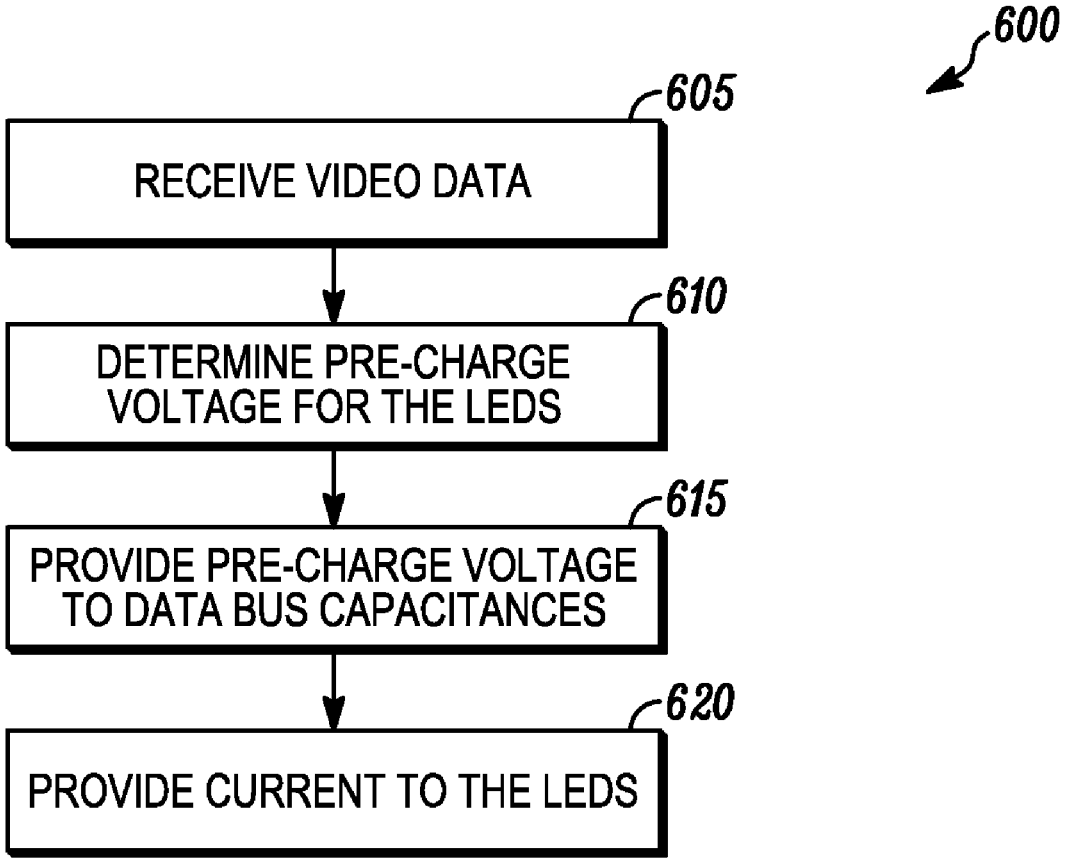
FIG. 6 is a flow diagram of a method for controlling the luminance of a display in accordance with one exemplary embodiment of the invention.

FIG. 6 is a flow diagram of one exemplary embodiment of a method 600 for controlling the luminance of a display (e.g., display 400). Method 600 begins by one or more column drivers (e.g., column drivers 420) receiving video data to be displayed on display 400 from a display timing controller (e.g., display timing controller 425 of FIG. 4) (step 605). The video data includes the color and/or brightness level of at least one column 107 of AMLED pixels 110 of display 400.

Column driver 420 then determines the pre-charge voltage needed for the capacitances (e.g., capacitive elements 244) on the data bus (e.g., data bus 235) (step 610). The pre-charge voltages vary depending on the color, delta feed-through current, and/or brightness required for each AMLED pixel 110. That is, the image (as dictated by the video data) to be displayed on display 400 determines the amount of voltage needed to pre-charge capacitive elements 244 prior to current being supplied from column driver 420 (via programming circuit 430). In one embodiment, column driver 420 matches the color and/or brightness level of each AMLED pixel 110 in the video data to the corresponding voltage representing that particular color and/or brightness level in a look-up table (e.g., look-up table 4412).

Once the pre-charge voltage is determined, column driver 420 provides the pre-charge voltage determined from look-up table 4412 to data bus 235 to pre-charge the capacitive elements 244 on data bus 235 (step 615). After the capacitive elements 244 have been pre-charged, column drivers 420 provide current (e.g., programming current) to each column 107 of AMLED pixels 110 in conjunction with each pair of row drivers 130 (step 620).

Figure 7:
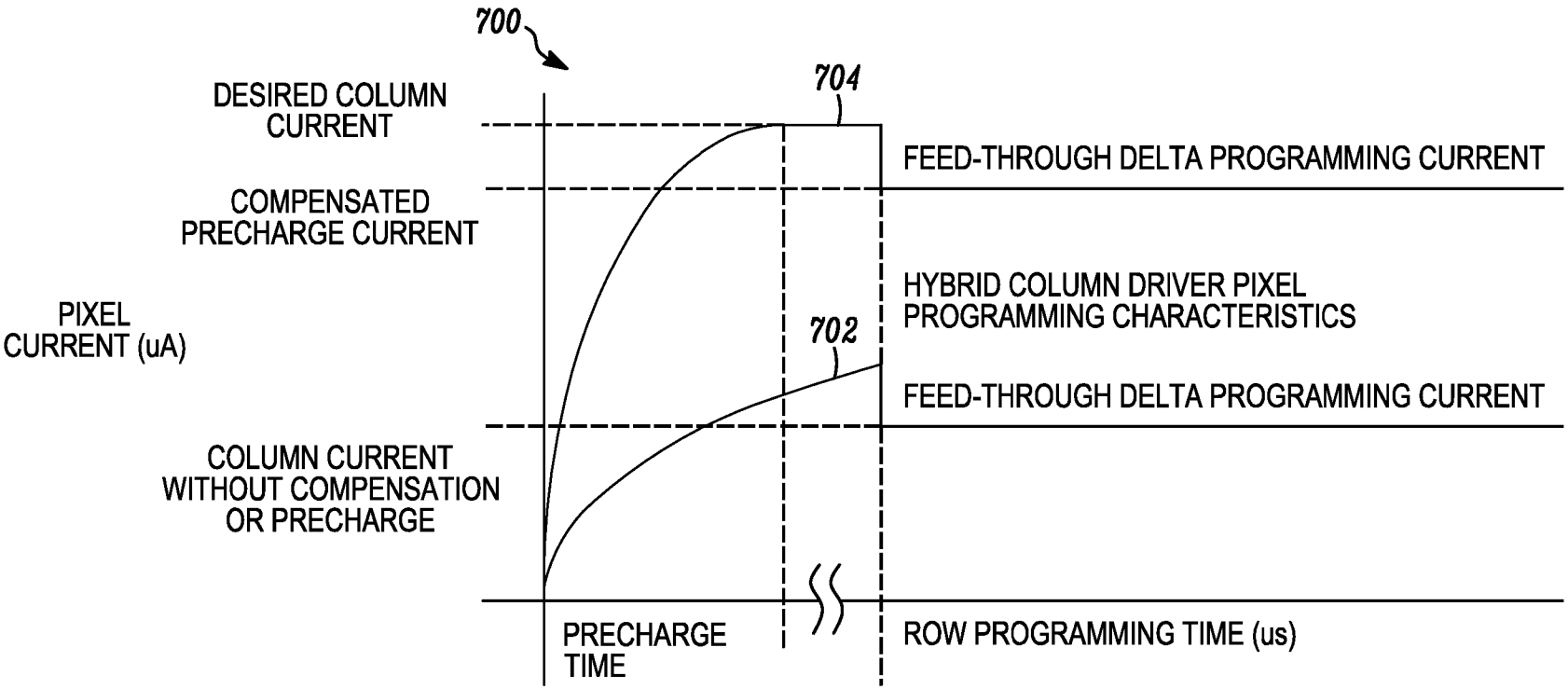
FIG. 7 is a graph illustrating an example of at least one of the advantages of the various embodiments of the invention.

FIG. 7 is a graph 700 illustrating an example of at least one of the advantages of the various embodiments of the invention. Graph 700 depicts a curve 702 representing the programming time of AMLED pixel 110 utilizing a conventional column driver (e.g., column driver 120), and a curve 704 representing the programming time of AMLED pixel 110 utilizing the various embodiments of column driver 420.

As illustrated, the programming time of AMLED pixel 110 is significantly less utilizing column driver 420. Furthermore, column driver 420 enables AMLED pixel 110 to be programmed with very small amounts of current, which allows AMLED pixel 110 to have a greater range of colors and/or a greater number luminance levels.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

We claim:

1. A driver for controlling the luminance of a display comprising a column of light-emitting diode (LED) pixels, the apparatus comprising:

a non-proportional look-up table residing in a memory device comprising a plurality of pre-charge voltage values representative of a plurality of luminance levels for each LED pixel;

a pre-charge voltage source;

a pre-charge circuit configured to supply a pre-charge voltage to the column of LED pixels from the pre-charge voltage source;

a programming circuit configured to supply a programming current to the column of LED pixels, wherein the pre-charge voltage source is different from the programming circuit; and a switch configured to selectively couple one of the pre-charge circuit and the programming circuit to the column of LED pixels.

2. The driver of claim 1, wherein the pre-charge circuit comprises a programmable voltage source coupled to the non-proportional look-up table.

3. The driver of claim 2, wherein the programmable voltage source is configured to supply a first pre-charge voltage to a column based on a first voltage value obtained from the non-proportional look-up table.

4. The driver of claim 3, wherein the programmable voltage source is configured to supply a second pre-charge voltage to the column based on a second voltage value obtained from the non-proportional look-up table.

5. The driver of claim 2, wherein the pre-charge circuit further comprises a digital-to-analog (DAC) converter coupled to the programmable voltage source, the DAC configured to receive the pre-charge voltage from the programmable voltage source.

6. The driver of claim 1, further comprising a non-proportional look-up table comprising a plurality of voltage values representative of a plurality of luminance levels for each LED coupled to the pre-charge circuit.

7. The driver of claim 1, further comprising a controller coupled to the pre-charge circuit, the programming circuit, and the switch, the controller configured to supply video data to the pre-charge circuit, the programming circuit, and the switch.

8. A display, comprising:

an array of light-emitting diode (LED) pixels arranged in a plurality of columns;

a plurality of pre-charge circuits, each pre-charge circuit configured to selectively supply a pre-charge voltage from itself to at least one column of LED pixels and each comprising a programmable voltage source configured to apply a first pre-charge voltage to a column and apply a second pre-charge voltage to the column;

a plurality of current sources, each configured to selectively supply current to at least one column of LED pixels.

9. The display of claim 8, further comprising a plurality of switches selectively coupling one of each of the pre-charge circuits and each of the current sources to each of the columns of LEDs.

10. The display of claim 9, further comprising a controller coupled to each of the plurality of current sources, each of the plurality of pre-charge circuits, and each of the plurality of switches, the controller configured to supply video data to each of the plurality of current sources, each of the plurality of pre-charge circuits, and each of the plurality of switches.

11. The display of claim 8, wherein each of the plurality of pre-charge circuits comprises:

a non-proportional look-up table comprising a plurality of voltage values representative of a plurality of luminance levels for each LED, the non-proportional look-up table coupled to each programmable voltage source.

12. The display of claim 11, wherein the programmable voltage source is configured to apply the first pre-charge voltage to a column based on a first voltage value obtained from the look-up table.

13. The display of claim 12, wherein the programmable voltage source is configured to apply the second pre-charge voltage to the column based on a second voltage value obtained from the look-up table.

14. The display of claim 8, wherein each of the plurality of pre-charge circuits further comprises a voltage digital-to-analog (VDAC) converter coupled to the programmable voltage source.

15. The display of claim 8, further comprising a plurality of non-proportional look-up tables comprising a plurality of voltage values representative of a plurality of luminance levels for each LED, each look-up table coupled to one of the plurality of pre-charge circuits.

16. The display of claim 8, further comprising a non-proportional look-up table comprising a plurality of voltage values representative of a plurality of luminance levels for each LED coupled to each of the plurality of pre-charge circuits.

17. A method for controlling the luminance of a display comprising a plurality of columns of light-emitting diode (LED) pixels characterized by a plurality of luminance levels, the method comprising the steps of:

determining a pre-charge voltage for each of the columns of LED pixels based on a target luminance level selected from the plurality of luminance levels from a non-proportional look-up table residing in a memory device comprising a plurality of pre-charge voltage values representative of a plurality of luminance levels for each LED pixel; and supplying the determined pre-charge voltages from a pre-charge voltage circuit to each of the columns of LED pixels.

18. The method of claim 17, wherein the determining step comprises the step of matching each target luminance level with a corresponding pre-charge voltage.

19. The method of claim 17, further comprising the step of receiving video data comprising the target luminance level for each of the columns of LEDs.

* * * * *